US009948066B2

(12) United States Patent
Niessner

(10) Patent No.: US 9,948,066 B2
(45) Date of Patent: Apr. 17, 2018

(54) SPARK PLUG

(71) Applicant: Federal-Mogul Ignition GmbH, Neuhaus-Schierschnitz (DE)

(72) Inventor: Werner Niessner, Steinheim (DE)

(73) Assignee: FEDERAL-MOGUL IGNITION GMBH, Neuhaus-Schierschni (DE)

( * ) Notice: Subject to any disclaimer, the term of this patent is extended or adjusted under 35 U.S.C. 154(b) by 41 days.

(21) Appl. No.: 15/199,294

(22) Filed: Jun. 30, 2016

(65) Prior Publication Data

US 2017/0005457 A1 Jan. 5, 2017

(30) Foreign Application Priority Data

Jul. 1, 2015 (DE) ..... 10 2015 110 601

(51) Int. Cl.
*H01T 13/32* (2006.01)
*H01T 13/46* (2006.01)

(52) U.S. Cl.
CPC ..... *H01T 13/32* (2013.01); *H01T 13/467* (2013.01)

(58) Field of Classification Search
CPC ..... H01T 13/32; H01T 13/467
See application file for complete search history.

(56) References Cited

U.S. PATENT DOCUMENTS

| | | | | |
|---|---|---|---|---|
| 1,138,797 | A | 5/1915 | Schmidt | |
| 1,679,988 | A | 8/1928 | Rabezzana | |
| 2,118,251 | A | 5/1938 | Koehler | |
| 2,292,974 | A | 8/1942 | Smithells | |
| 2,586,864 | A | 2/1952 | Rose | |
| 2,614,548 | A | 10/1952 | Dutterer | |
| 2,640,474 | A | 6/1953 | Phillips | |
| 2,652,043 | A | 9/1953 | Johnson | |
| 2,652,044 | A | 9/1953 | Phillips | |
| 2,712,685 | A | 7/1955 | Johnson | |
| 2,944,178 | A | 7/1960 | Schaub | |
| 4,275,328 | A * | 6/1981 | Watanabe | H01T 13/462 313/123 |
| 4,319,552 | A | 3/1982 | Sauer | |
| 6,406,345 | B2 | 6/2002 | Boehler | |
| 9,093,823 | B2 | 7/2015 | Sakakura | |
| 2012/0299459 | A1 | 11/2012 | Sakakura | |

FOREIGN PATENT DOCUMENTS

| | | |
|---|---|---|
| DE | 346848 C | 1/1922 |
| EP | 0134355 A1 | 3/1985 |
| EP | 2525452 | 11/2012 |

OTHER PUBLICATIONS

German Office Action for Application No. 102015110601.9 dated Feb. 19, 2016, 6 pages.

* cited by examiner

*Primary Examiner* — Anne Hines
(74) *Attorney, Agent, or Firm* — Reising Ethington, P.C.

(57) ABSTRACT

A spark plug having a center conductor, an insulator surrounding the center conductor, a body surrounding the insulator, and a center electrode connected in an electrically conductive manner to the center conductor, wherein the center electrode delimits a spark gap with its front face. The spark plug has two bar-shaped ground electrodes that are connected in an electrically conductive manner to the body, that delimit the spark gap, and that are adjacent to one another and spaced apart from one another in the region of the spark gap.

19 Claims, 2 Drawing Sheets

SPARK PLUG

This Application claims the benefit of German Application No. 10 2015 110 601.9, filed on Jul. 1, 2015, the contents of which are hereby incorporated by reference in their entirety.

FIELD

The invention is based on a spark plug having a center conductor, having an insulator surrounding the center conductor, having a body surrounding the insulator, and having a center electrode connected in an electrically conductive manner to the center conductor, said center electrode delimiting a spark gap with its front face.

BACKGROUND

Spark plugs of this type have long been known and are used in internal combustion engines. Spark plugs are known which each have a ground electrode that is connected in an electrically conductive manner to the body and that forms a spark gap together with the front face of the center electrode. The width of the known ground electrodes is greater than the diameter of the front face of the center electrode.

SUMMARY

An object of the invention is attained by a spark plug with the features of claim 1. Advantageous enhancements are the subject matter of the dependent claims.

A spark plug according to one embodiment has two bar-shaped ground electrodes that are connected in an electrically conductive manner to the body and delimit the spark gap. The two ground electrodes are adjacent to one another and spaced apart from one another, in particular parallel to one another, in the region of the spark gap. Each of the ground electrodes can be composed of a precious metal rod, in particular in one piece. A rod for a ground electrode can be manufactured from a precious metal alloy, for example with platinum or iridium as the main constituent.

The present design may provide certain advantages, including the following:

The electrode arrangement has the effect that the ignition spark produced extends approximately in the axial direction of the spark plug, which contributes to good ignition of the mixture.

The ignition of the mixture is improved by the means that the two electrodes run spaced apart from one another. The spacing between the two electrodes produces good accessibility of the spark gap for the gas/air mixture and improves the propagation of the flame front of the ignited mixture, in particular into the prechamber of the cylinder head. At the same time, the present design guarantees that the available electrode consumption area at the ground electrodes still remains large enough to ensure a long service life for the spark plug.

The electrode spacing in the region of the spark gap can be adjusted in the event of wear occurring at the electrodes. Thus further increases the service life of the spark plug, and the precious metals used for the electrodes are utilized more fully.

The spark plug has a very long service life and at the same time is very robust. In the case of ground electrodes composed of precious metal rods, the precious metal is utilized very well in order to achieve the longest possible service life for the ground electrodes. Because of the small cross-sectional dimensions of the rods, only a small quantity of precious metal is required for the ground electrodes.

As a result of a straight, bend-free design of the ground electrodes, it is possible to keep their required length small and simplify the manufacture of the spark plug.

A spark plug according to the present design is especially good for use in prechamber gas engines, is suitable in particular for stationary, gas-powered internal combustion engines. It allows low temperatures of the ground electrodes, in particular because the ground electrodes can be very short in design.

In an embodiment of the spark plug, at least the section of each of the ground electrodes located in the region of the spark gap can be transverse to the center conductor. Viewed in an end view of the front face of the body, at least the two sections of the two ground electrodes located in the region of the spark gap can run spaced apart from one another adjacent to an imaginary line that is transverse to the center conductor through the center of the front face of the center electrode. The ground electrodes can run on opposite sides of the imaginary line, and in particular can have the same spacing from the imaginary line. This centered embodiment can promote ignition. Each of the two ground electrodes can have a flat surface section that delimits the spark gap. A rod-shaped ground electrode can have different cross-sectional shapes, for example the shape of a triangle, rectangle, square, or hexagon.

In another embodiment of the spark plug, the two ground electrodes can be attached, in particular welded, to the front face of the body, wherein the attachment points can be located opposite one another on the front face of the body. Each of the ground electrodes can sit in a groove located on the front face of the body. The groove on the front face of the body makes it possible to place the ground electrode in the groove during manufacture, with the ground electrode being aligned by the groove even before it is welded on, so that deviations in the direction of the ground electrode after the welding process are reduced. The body can project past the front face of the center electrode. It is thus possible to achieve a spark location that lies approximately at the same level as the end of the body. In order to achieve good adjustability of the electrode spacing, at least one adjusting recess can be located at the front face of the body, permitting access to the spark gap in a direction perpendicular to the center conductor. In particular, two adjusting recesses are located opposite one another at the front face of the body. The direction in which the spark gap can be accessed through the adjusting recesses can be transverse to one of the ground electrodes.

In another embodiment, the spacing between the two ground electrodes in the region of the spark gap can be greater than the spacing from each of the ground electrodes to the front face of the center electrode. The spacing between the two ground electrodes in the region of the spark gap can be, for example, 0.2 mm to 0.6 mm, in particular approximately 0.4 mm. The spacing from each of the ground electrodes to the front face of the center electrode can be, for example, 0.1 mm to 0.5 mm, in particular approximately 0.25 mm.

DRAWINGS

Preferred exemplary embodiments of the invention will hereinafter be described in conjunction with the appended drawings, wherein like designations denote like elements, and wherein.

DESCRIPTION

Figure 1:
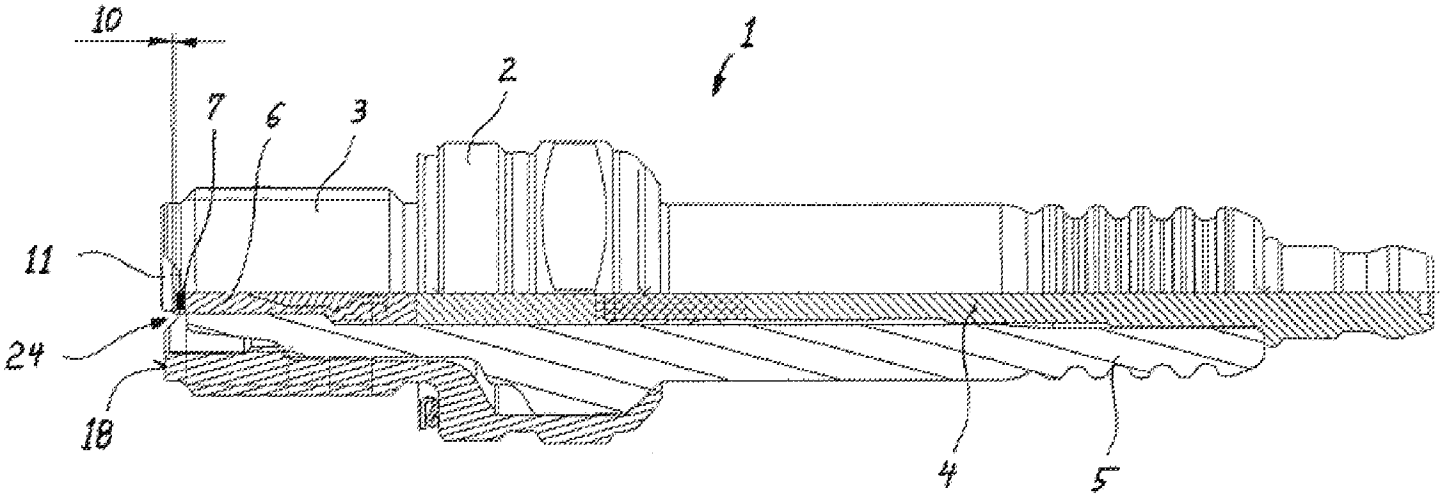
FIG. 1 shows a side view, cross-sectional on one side, of an exemplary spark plug.
Figure 3:
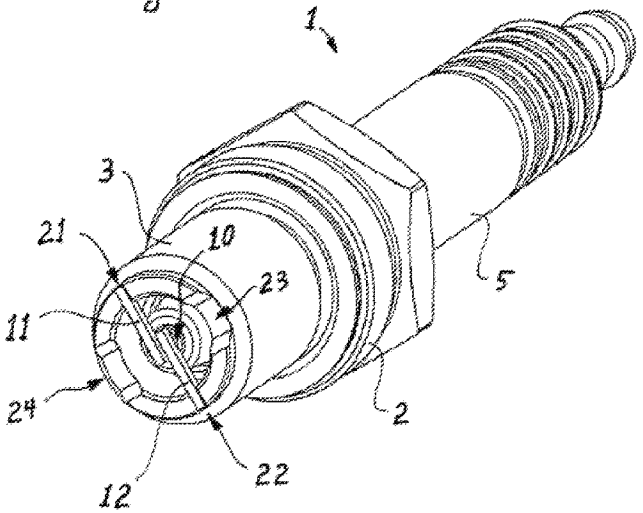
FIG. 3 shows a perspective view of the spark plug from FIG. 1.

The spark plug 1 shown in the figures has a body 2 with a thread 3 at its front end with which the spark plug 1 is screwed into a cylinder head, not shown, of a stationary, gas-powered internal combustion engine. The spark plug 1 includes a center conductor 4 that is surrounded by an insulator 5. The insulator sits in a passage of the body 2 and is surrounded by the body 2. The insulator 5 projects out of the body 2 at the back end. There, the center conductor 4 projects from the insulator and can be supplied with ignition voltage in a manner known per se via terminal devices that are not shown. The spark plug 1 has a center electrode 6 that is connected in an electrically conductive manner to the center conductor 4 and that delimits a spark gap 10 with its front face 7; see dimension 10 in FIG. 1. The center electrode 6 can have a precious metal reinforcement at its front face 7, for example in the form of a welded-on round blank made of iridium or platinum.

Figure 2:
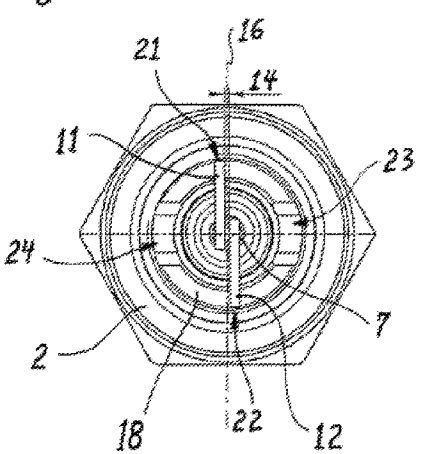
FIG. 2 shows a plan view from below of the front face of the body of the spark plug from FIG. 1.

The spark plug 1 has two bar-shaped ground electrodes 11 and 12, each consisting of a precious metal rod. The ground electrodes 11, 12 each run in a straight line and transversely to the center conductor 4, and are also parallel to one another. The two ground electrodes 11, 12 are connected in an electrically conductive manner to the body 2 and delimit the spark gap 10. The two ground electrodes 11, 12 run next to one another and are spaced apart from one another in the region of the spark gap 10. The spacing between the two ground electrodes 11, 12 is labeled in FIG. 2 with the dimension 14, which is 0.4 mm, for example. The spacing 14 is greater than the spacing 10 (spark gap) from each of the ground electrodes 11, 12 to the front face 7. It is evident from the plan view in FIG. 2 that the two ground electrodes 11, 12 run spaced apart from one another next to an imaginary line 16, which is shown as a dotted-and-dashed line and which is perpendicular to the center conductor 5 through the center of the front face 7 of the center electrode 6. At the same time, the imaginary line 16 runs through the center of the spark plug 1.

The body 2 has at its forward end a front face 18 that projects past the front face 7 of the center electrode 5. Located at the front face 18 are two grooves 21, 22 arranged opposite one another and two adjusting recesses 23, 24 arranged opposite one another. The ground electrode 11 sits in the groove 21 and is welded to the body 2 there. The ground electrode 12 sits in the groove 22 and is welded to the body 2 there. The grooves 21, 22 represent attachment points for the ground electrodes 11, 12, which are located on opposite sides of the front face 18 from one another. The adjusting recesses 23, 24 permit access to the spark gap 10 in a direction perpendicular to the center conductor 4 that is also transverse to the ground electrodes 11, 12. The adjusting recesses are used for setting, in particular adjusting, the electrode spacing in the region of the spark gap; see dimension 10 in FIG. 1.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

LIST OF REFERENCE NUMERALS

1 spark plug
2 body
3 thread
4 center conductor
5 insulator
6 center electrode
7 front face
10 spark gap
11 ground electrode
12 ground electrode
16 imaginary line
18 front face
21 groove
22 groove
23 adjusting recess
24 adjusting recess

The invention claimed is:

1. A spark plug having a center conductor, an insulator surrounding the center conductor, a body surrounding the insulator, and a center electrode connected in an electrically conductive manner to the center conductor, the center electrode delimits a spark gap with its front face, wherein the spark plug has two bar-shaped ground electrodes that are connected in an electrically conductive manner to the body, that delimit the spark gap, and that run next to one another and are spaced apart from one another in the region of the spark gap, wherein when viewed in a plan view of the front face of the body, at least sections of the two ground electrodes located in the region of the spark gap are adjacent to and spaced apart from an imaginary line that runs through the center of the front face of the center electrode and is transverse to the center conductor.

2. The spark plug according to claim 1, wherein at least sections of the two ground electrodes located in the region of the spark gap are parallel to one another.

3. The spark plug according to claim 1, wherein at least a section of each of the ground electrodes located in the region of the spark gap is transverse to the center conductor.

4. The spark plug according to claim 1, wherein each of the two ground electrodes has a flat surface section that delimits the spark gap.

5. The spark plug according to claim 1, wherein each of the two bar-shaped ground electrodes extends in a straight line.

6. The spark plug according to claim 1, wherein the spacing between the two ground electrodes in the region of the spark gap is greater than the spacing from each of the ground electrodes to the front face of the center electrode.

7. The spark plug according to claim 1, wherein the ground electrodes are each composed of a precious metal rod.

8. The spark plug according to claim 1, wherein both ground electrodes are attached to the front face of the body and the attachment points are located opposite one another on the front face of the body.

9. The spark plug according to claim 1, wherein the body projects past the front face of the center electrode.

10. A spark plug having a center conductor, an insulator surrounding the center conductor, a body surrounding the insulator, and a center electrode connected in an electrically conductive manner to the center conductor, the center electrode delimits a spark gap with its front face, wherein the spark plug has two bar-shaped ground electrodes that are connected in an electrically conductive manner to the body, that delimit the spark gap, and that run next to one another and are spaced apart from one another in the region of the spark gap, wherein both ground electrodes are attached to the front face of the body and the attachment points are located opposite one another on the front face of the body.

11. The spark plug according to claim 10, wherein each of the ground electrodes sits in a groove located on the front face of the body.

12. The spark plug according to claim 10, wherein at least sections of the two ground electrodes located in the region of the spark gap are parallel to one another.

13. The spark plug according to claim 10, wherein at least a section of each of the ground electrodes located in the region of the spark gap is transverse to the center conductor.

14. The spark plug according to claim 10, wherein when viewed in a plan view of the front face of the body, at least sections of the two ground electrodes located in the region of the spark gap are adjacent to and spaced apart from an imaginary line that runs through the center of the front face of the center electrode and is transverse to the center conductor.

15. The spark plug according to claim 10, wherein each of the two ground electrodes has a flat surface section that delimits the spark gap.

16. The spark plug according to claim 10, wherein each of the two bar-shaped ground electrodes extends in a straight line.

17. A spark plug having a center conductor, an insulator surrounding the center conductor, a body surrounding the insulator, and a center electrode connected in an electrically conductive manner to the center conductor, the center electrode delimits a spark gap with its front face, wherein the body projects past the front face of the center electrode, wherein the spark plug has two bar-shaped ground electrodes that are connected in an electrically conductive manner to the body, that delimit the spark gap, and that run next to one another and are spaced apart from one another in the region of the spark gap.

18. The spark plug according to claim 17, wherein at least one adjusting recess for adjusting the electrode spacing is located at the front face of the body, permitting access to the spark gap in a direction perpendicular to the center conductor.

19. The spark plug according to claim 18, wherein the direction in which the spark gap is accessible through the adjusting recess is transverse to one of the ground electrodes.

* * * * *